US007627918B2

(12) United States Patent
Lee

(10) Patent No.: US 7,627,918 B2
(45) Date of Patent: Dec. 8, 2009

(54) DEHYDRATING METHOD OF DRUM TYPE WASHING MACHINE

(75) Inventor: Woon Yong Lee, Gwangju-gwangyok-si (KR)

(73) Assignee: LG Electronics Inc., Seoul (KR)

( * ) Notice: Subject to any disclaimer, the term of this patent is extended or adjusted under 35 U.S.C. 154(b) by 499 days.

(21) Appl. No.: 11/437,866

(22) Filed: May 22, 2006

(65) Prior Publication Data

US 2007/0022543 A1 Feb. 1, 2007

(30) Foreign Application Priority Data

May 23, 2005 (KR) ..... 10-2005-0043193
May 23, 2005 (KR) ..... 10-2005-0043194
May 23, 2005 (KR) ..... 10-2005-0043195
May 23, 2005 (KR) ..... 10-2005-0043196

(51) Int. Cl.
*D06F 33/00* (2006.01)
*D06F 35/00* (2006.01)

(52) U.S. Cl. ..... 8/158

(58) Field of Classification Search ..... 68/12.04, 68/12.06, 12.12, 12.14, 23 R, 24; 8/158, 8/159

See application file for complete search history.

(56) References Cited

U.S. PATENT DOCUMENTS 5,325,677 A * 7/1994 Payne et al. ..... 68/12.04
6,029,300 A * 2/2000 Kawaguchi et al. ..... 8/159
2003/0182975 A1* 10/2003 Tomigashi et al. ..... 68/12.04

* cited by examiner

*Primary Examiner*—Joseph L Perrin
(74) *Attorney, Agent, or Firm*—McKenna Long & Aldridge LLP

(57) ABSTRACT

A dehydrating method of a drum type washing machine for precisely detecting a single load for a dehydrating cycle to effectively dehydrate is disclosed. A drum type washing machine for detecting a single load to distinguish the detected single load into a long single load and a short single load, so that effective dehydrating is carried out, is disclosed. The dehydrating method includes the step of determining whether the laundry is the single load. A following dehydrating method varies with whether the laundry is the single load or not.

19 Claims, 7 Drawing Sheets

DEHYDRATING METHOD OF DRUM TYPE WASHING MACHINE

This application claims the benefit of Korean Patent Application No. 10-2005-0043193, filed on May 23, 2005; Korean Patent Application No. 10-2005-0043194, filed on May 23, 2005; Korean Patent Application No. 10-2005-0043195, filed on May 23, 2005; and Korean Patent Application No. 10-2005-0043196, filed on May 23, 2005, which are hereby incorporated by reference for all purposes as if fully set forth herein.

This application claims the benefit of Korean Patent Application Nos. 10-2005-0043193, 10-2005-0043194, 10-2005-0043195 and 10-2005-0043196 filed on May 23, 2005, which are hereby incorporated by references as if fully set forth herein.

BACKGROUND OF THE INVENTION

1. Field of the Invention

The present invention relates to a dehydrating method of a drum type washing machine, and more particularly, to a dehydrating method of a drum type washing machine for precisely detecting a single load for a dehydrating cycle to effectively dehydrate.

The present invention relates to a dehydrating method of a drum type washing machine for distinguishing a single load into a long single load and a short single load based on a length of laundry when the laundry is unfolded in a case when the laundry inserted into a drum of the drum type washing machine is the single load to effectively dehydrate.

The present invention relates to a drum type washing machine for detecting a single load to distinguish the detected single load into a long single load and a short single load so that effective dehydrating is carried out.

2. Discussion of the Related Art

Generally, a washing machine is an apparatus for washing laundry to separate contaminants from the laundry such as clothes, bedclothes, or the like (hereinafter referred to as "laundry") using washing water and detergent during a washing cycle, a rinsing cycle, a dehydrating cycle, and a drying cycle.

FIG. 1 is a sectional view illustrating the internal structure of a conventional drum type washing machine.

The conventional drum type washing machine, as shown in FIG. 1, includes a cabinet 2, a tub 8, a drum 10, a lifter 12, and a motor 14.

The cabinet 2 forms the whole external appearance of the conventional drum type washing machine, the tub 8 accommodates washing water and is installed in the cabinet to be buffered by a spring 4 and a damper 6. The drum 10 accommodates the laundry and is disposed to rotate in the tub 8. In the outer circumference of the drum 10, a plurality of water holes 10A are formed and the washing water is introduced into a space defined by the drum 10 and the tub 8.

Moreover, in the inner wall of the drum 10, the lifter 12 is installed to lift the laundry up to a predetermined height such that the laundry drops during the rotation of the drum 10.

A motor is provided to transmit the rotation force to the drum 10. Recently, a directly coupling type motor, in which the motor 14 is mounted in the rear side of the tub 8, is widely employed.

Meanwhile, the conventional drum type washing machine further includes a cabinet cover 16 installed in the front side of the cabinet 2 and having a laundry entrance 16A formed in the central area of the cabinet 2, and a door 18 pivotally installed to the cabinet cover 16 to open and close the laundry entrance 16A.

The conventional drum type washing machine further includes a control panel having a controller for controlling the conventional drum type washing machine, and a hall sensor 22 installed at a side of the motor 14 to detect the rotation speed of the motor (RPM) and a rotation angle.

In the upper side of the cabinet 2, a top plate 24 is mounted. In the lower side of the top plate 24, a water supply 30, including a water supplying hose 26 and a water supplying valve to supply washing water into the tub 8 from an external water source, is installed. In a water supplying passage of the water supplying device 30, a detergent supplying device 32 for supplying detergent together the washing water supplied into the tub 8 is installed to communicate with the tub 8.

In the lower side of the tub 8, in order to exhaust the washing water used during the washing cycle and the rinsing cycle to the exterior, is installed an exhaust device 40 including an exhausting hose 34, an exhausting pump 36, and an exhausting bellows 38.

The hall sensor 22 generates a pulse signal according to the positional change of the motor 14, and RPM and a rotation angle of the motor 14 are measured using the pulse signal.

Operation of the conventional drum type washing machine will be described.

Firstly, the door 18 is opened to insert the laundry into the drum 10 through the laundry entrance 16A. After sealing the laundry entrance 16A by closing the door 18, a proper quantity of detergent is inserted into the detergent supplying device 32 according to the kind and quantity of the laundry inserted into the drum 10. Naturally, the supply of the detergent may be carried out manually or may be automatically controlled.

When the conventional drum type washing machine 1 starts to operate, the quantity of the laundry inserted into the drum 10 is detected, based on the detected quantity of the laundry, a washing method such as the washing course, the washing time, the level of the water to be supplied, the quantity of the detergent, and the like is determined, and the conventional drum type washing machine 1 is driven by the washing method.

In other words, when the washing water is supplied into the tub 8 by the water supplying device 30, the detergent inserted into the detergent supplying device 32 is mixed with the washing water supplied by the water supplying device 30 and is also supplied into the tub 8.

After the washing water is accommodated in the tub 8 to a predetermined level, and when the drum 10 is rotated by the motor 14, the laundry is lifted up to a predetermined height by the lifter 12 installed in the drum 10 and then drops due to gravity. At this time, due to the falling force of the laundry and the interaction of the laundry with the washing water, the contaminants are separated from the laundry.

When the washing cycle is completed, the contaminated washing water in the tub 8 is exhausted out of the conventional drum type washing machine through the exhaust device 40.

After this, the conventional drum type washing machine 1 performs the rinsing cycle, for removing bubbles and detergent remaining in the laundry, several times. In other words, clean washing water is supplied into the tub 8 by the water supplying device 30 up to the predetermined level and the drum 10 is rotated by the motor 14 so that the laundry is rinsed and after that the used washing water is exhausted out through the exhaust device 40.

When the several rinsing cycles are completed, the drum 10 is rotated at a high speed by the motor 14 to dehydrate the laundry, and if a drying device is provided in the conventional drum type washing machine 1, the drying cycle is also carried out.

FIG. 2 is a graph illustrating RPM of the motor with respect to time in the dehydrating cycle of the conventional drum type washing machine. As shown in the graph, the dehydration is carried out by controlling the RPM of the motor.

The dehydrating method of in the conventional drum type washing machine will be described as follows.

The dehydrating method of the conventional drum type washing machine includes the steps of (1) detecting a quantity of laundry for determining an optimal dehydrating time or a dehydrating RPM, (2) detecting eccentricity for determining the starting of a main dehydration or untangling of the laundry, and (3) controlling the motor 14 at a high speed after the steps (1) or (2).

As shown in FIG. 2, when the washing cycle or the rinsing cycle is completed, sequentially, the step (1) is carried out twice (time period a) and the step (2) is carried out at least once (time period b).

During the step (1) (time period a), the motor 14 is accelerated to a predetermined RPM, and when the RPM reaches the first predetermined RPM RPM1, the first predetermined RPM RPM1 is maintained and the motor is turned off.

At this time, a duty value of the pulse width modulation (PWM) when a static speed is maintained at the first predetermined RPM RPM1 and a surplus angle after turning off of the motor 14 are measured to detect the quantity of the laundry.

During the step (2) (time period b), the motor 14 is accelerated such that the RPM reaches a second predetermined RPM RPM2 greater than the first predetermined RPM RPM1, and when the RPM reaches the second predetermined RPM RPM2, the second predetermined RPM RPM2 is maintained and after that the motor 14 is turned off. At this time, using an RPM ripple when a static speed is maintained at the second predetermined RPM RPM2, the eccentricity of the laundry is detected.

The above-mentioned conventional drum type washing machine 1, performs untangling of the laundry (time period c) for the removal of the eccentricity and performs the step (2) (time period b').

On the other hand, when the eccentricity detected during the initial eccentricity detection (time period b) or after the untangling of the laundry (time period c) is lower than a predetermined value, the conventional drum type washing machine 1 drives the motor 14 at a third predetermined RPM RPM3, higher than the second predetermined RPM RPM2, to dehydrate the laundry using the centrifugal force at a high speed.

The above-mentioned main dehydration (time period d) consists of an optimal dehydrating time based on the quantity of the laundry detected during the step (1) (time period a) or the dehydration RPM.

However, according to the dehydrating method of the conventional drum type washing machine, when the laundry inserted into the drum 10 is a single load of a single piece of laundry, time for detecting the eccentricity (time period b) and time for untangling the laundry (time period c) are remarkably increased so that the starting time of the main dehydrating step is significantly shortened.

In other words, the laundry inserted into the drum 10 is divided into a big quantity load, a medium quantity load, and a small quantity load based on the quantity of the laundry. The small quantity load includes a single load consisting of a single piece of laundry.

Naturally, in this patent application, the single load means that the number of pieces of laundry is one. The single load may include other laundry such as handkerchief that does not influence the load substantially.

The single load may be divided into a long single load and a short single load according to a length when the laundry is unfolded. The long single load is a single load such that when the laundry is unfolded its length is greater than a radial directional height of the drum 10 and the short single load is a single load such that when the laundry is unfolded its length is less than the radial directional height of the drum 10.

In more detail, the long single load is a piece of laundry which is longer than a half of the inner circumferential length of the drum 10 when the laundry closely contacts and is completely unfolded on the inner circumference, and the short single load is a piece of laundry which is shorter than a half of the inner circumferential length of the drum 10.

Thus, when the long single load is unfolded to be long on the inner circumference of the drum 10 in the circumferential direction during the untangling of the laundry, the eccentricity is removed and the dehydration can be performed. However, the short single load is always unbalanced in the drum even when the untangling of the laundry (time period c) and the detection of the eccentricity (time period b) are performed several times.

Meanwhile, in the dehydrating method of the conventional drum type washing machine, when the eccentricity is not removed even after repeating the untangling (time period c) and the detection of the eccentricity (time period b) a predetermined number of times, the main dehydrating step is forcibly performed.

Thus, since unnecessary untangling (time period c) and the detection of the eccentricity (time period b) are repeated a predetermined number of times in a case of the short single load, entire time for the dehydration is increased in the conventional drum type washing machine 1, so that it may cause consumers to complain. It is because the untangling and the detection of the eccentricity are meaningless in the case of the short single load.

Therefore, according to the dehydrating method of the conventional drum type washing machine, in a case of a single load, since the dehydration of the laundry is not processed by the optimal dehydrating method, vibration of the conventional drum type washing machine 1 is more serious during the main dehydrating step, and the conventional drum type washing machine 1 vibrates seriously.

Even in a case of the single load in the conventional drum type washing machine, during the untangling of the laundry (time period c), the rotation direction of the drum 10 is reversed a predetermined number of times to reduce the eccentricity of the laundry. Thus, like that the drum 10 rotates slow or stops, since a time period when the untangling is not performed occurs, the untangling is inferior in effect and time is longer even in the case of the single load. Naturally, according to the length of the single load, the untangling time may be meaningless.

Moreover, in the dehydrating method of the conventional drum type washing machine, even in the case of the single load, the detection of the eccentricity (time period b) is automatically started when the untangling (time period c) is processed a predetermined number of times regardless of the eccentricity of the laundry. Thus, in the case of the single load, since the detection of the eccentricity is not carried out at a proper time, times for detecting the eccentricity are increased.

Naturally, according to the length of the single load, the time of detecting the eccentricity may be meaningless.

SUMMARY OF THE INVENTION

Accordingly, present invention is directed to a dehydrating method of a drum type washing machine that substantially obviates one or more problems due to limitations and disadvantages of the related art.

A first object of the present invention is to provide a dehydrating method of a drum type washing machine in which a single load is precisely and rapidly detected during a dehydrating cycle so that dehydration is effectively carried out.

A second object of the present invention is to provide a drum type washing machine for effectively dehydrating laundry.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dehydrating method of a drum type washing machine dehydrating water included in laundry by a motor rotating a drum, the dehydrating method including the step of determining whether the laundry is single load, wherein a following dehydrating method varies with whether the laundry is the single load or not.

Here, the step of determining whether the laundry is the single load is performed in an initial state of dehydration.

Preferably, in the step of determining whether the laundry is the single load, the RPM of the drum is sensed for a predetermined time after a set voltage is applied to the motor so that it is determined that the laundry is the single load when the RPM of the drum is larger than a reference RPM The set voltage is obtained by setting a voltage input from an external power source as a voltage ratio of a set duty.

The reference RPM is the RPM of the drum when the set voltage is applied to the motor and the laundry is the single load having the maximum size of load. In other words, the reference RPM is an RPM of the drum when laundry having the maximum load is accommodated in the drum and a predetermined voltage is applied to the motor to rotate the drum. Here, the reference RPM may be determined as an optimized value by experiment.

Meanwhile, when it is determined in the step of determining whether the laundry is the single load that the laundry is non-single load, the dehydrating method further includes the steps of detecting the quantity of the laundry, detecting the eccentricity of the laundry, and rotating the drum at high speed to perform dehydration.

Here, the laundry untangling step when the detected eccentricity is not less than a predetermined value in the step of detecting the eccentricity is further carried out. The dehydration time or dehydration RPM in the step of rotating the drum at high speed to perform dehydration is determined by the quantity of the laundry detected in the step of detecting the quantity of the laundry.

Moreover, when it is determined in the step of determining whether the laundry is the single load that the laundry is the single load, the dehydrating method further includes the steps of the motor increasing and reducing speed in a laundry flowing RPM range to perform the laundry untangling, detecting the eccentricity of the laundry, and rotating the drum at high speed to perform dehydration.

Naturally, even when the single load is detected, the dehydrating including the main dehydrating step is performed like the case of the non-single load. However, in this case, it the laundry quantity detecting step may be omitted. It is because the single load may be equivalent to a medium load, but the main aspect of the dehydrating method of the present inventions relates mainly to a small load of the laundry.

Thus, in the single load detecting step, when the laundry is detected as the single load, since the laundry is automatically assumed to be the small load, there is no need of a separate laundry quantity detecting step.

In the laundry untangling step there is preferably included the sub-step of measuring the speed difference of the drum caused by the eccentricity of the laundry to determine whether to start the eccentricity detection step.

The laundry flowing RPM range is a range between the minimum RPM in which the laundry flows in the drum and the minimum RPM in which the laundry closely contacts the inner circumference of the drum so that the laundry is not detached.

Meanwhile, in the laundry untangling step, speed is increased to the minimum RPM in which the laundry is not detached and is reduced to the minimum RPM in which the laundry flows.

Here, the speed difference measuring step is performed at the point of time when the speed is increased to the minimum RPM in which the laundry is not detached in the laundry untangling step.

The speed difference is a difference between the speed of the drum when the laundry is lifted and the speed of the drum when the laundry falls, and the eccentricity detecting step starts when the measured speed deviation is less than the reference speed difference. It is because when the measured speed difference is lower than the reference speed difference, it can be assumed that the laundry is untangled to some degree.

The laundry untangling step is repeatedly performed by a first predetermined number of times in the same rotation direction, and the speed difference measuring step is performed whenever the laundry untangling step is repeatedly performed.

Moreover, when the eccentricity detection step does not start until the speed difference measuring number of times reaches the first set number of times, the laundry untangling step is repeatedly performed until the speed difference measuring number of times reaches a second predetermined number of times after the rotation direction of the drum is reversed.

Meanwhile, the laundry untangling step includes the step of determining the length of the single load. In other words, it is determined whether there is a long single load and a short single load.

When it is determined that the single load is a short single load the laundry untangling step does not proceed to the eccentricity detection step. But preferably the main dehydrating step starts when the short single load is determined. This is because the eccentricity detection may be meaningless for a short single load.

Moreover, when the plurality of speed differences measured in the speed difference measuring step are no less than the reference speed difference, it is determined whether the single load is a short single load so as to start the main dehydration step, and the main dehydrating step starts when the short single load is determined. This is because the eccentricity detection may be meaningless as described above.

Like the same method, when at least one of the measured plurality of speed differences is less than the reference speed difference, it is determined whether the single load is a long single load so as to start the eccentricity detecting step. In this case, the laundry untangling or the eccentricity removal may be meaningful.

Moreover, when it is determined that the eccentricity of the laundry is smaller than the reference eccentricity in the eccentricity detecting step, the main dehydration step begins, and when the eccentricity of the laundry is larger than the reference eccentricity, the laundry untangling step is performed again.

Meanwhile, in another aspect of the present invention, a drum type washing machine performs dehydration using one dehydrating method of the dehydrating methods as described above.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a dehydrating method of a drum type washing machine further understanding of the invention and are incorporated in and constitute a part of this application, illustrate embodiment (s) of the invention and together with the description serve to explain the principle of the invention. In the drawings.

DETAILED DESCRIPTION OF THE INVENTION

Reference will now be made in detail to the preferred embodiments of a, examples of which are illustrated in FIGS. 3 to 8.

Figure 1:
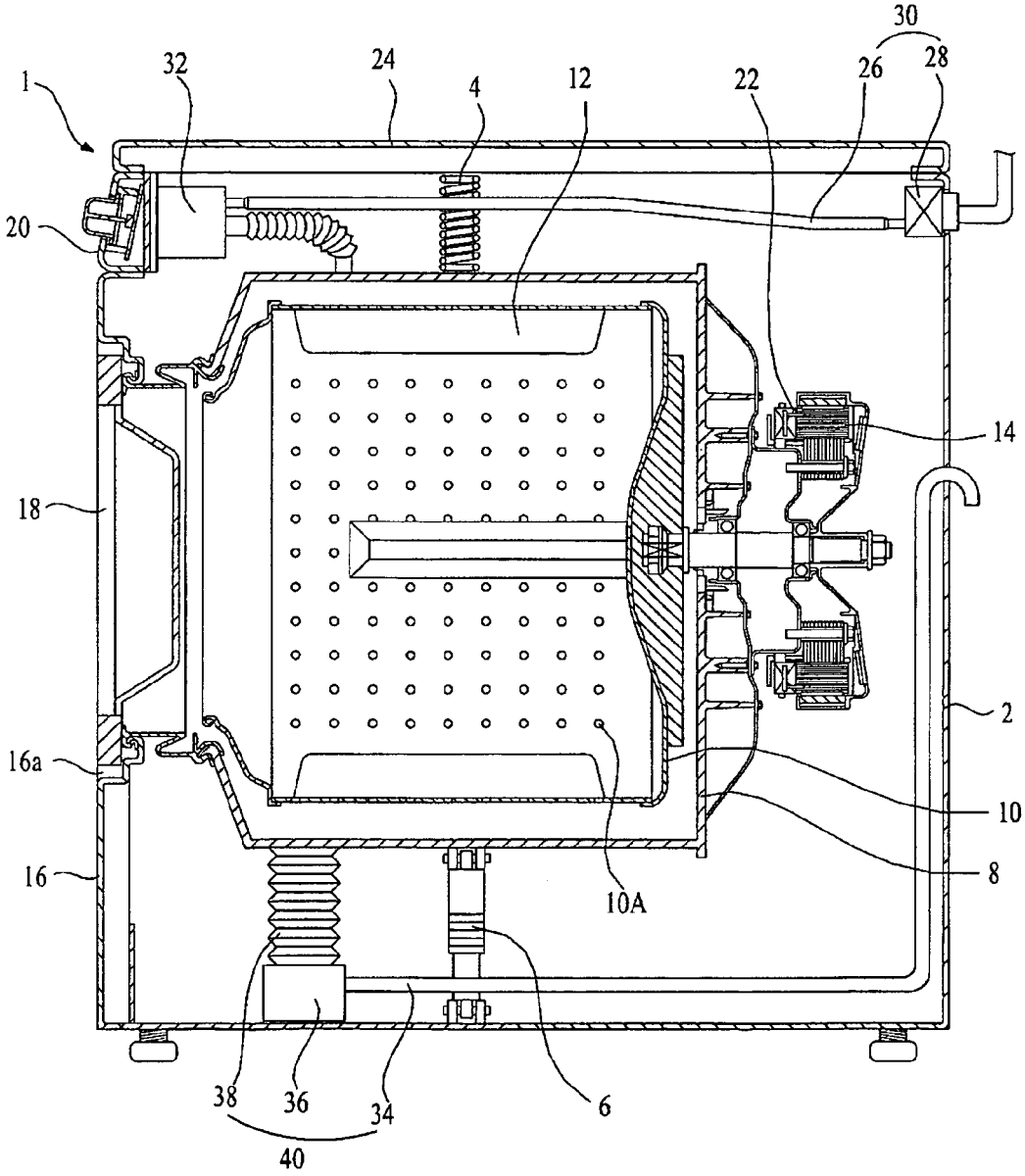
FIG. 1 Related Art
FIG. 1 is a sectional view illustrating the internal structure of a conventional drum type washing machine.
Figure 2:
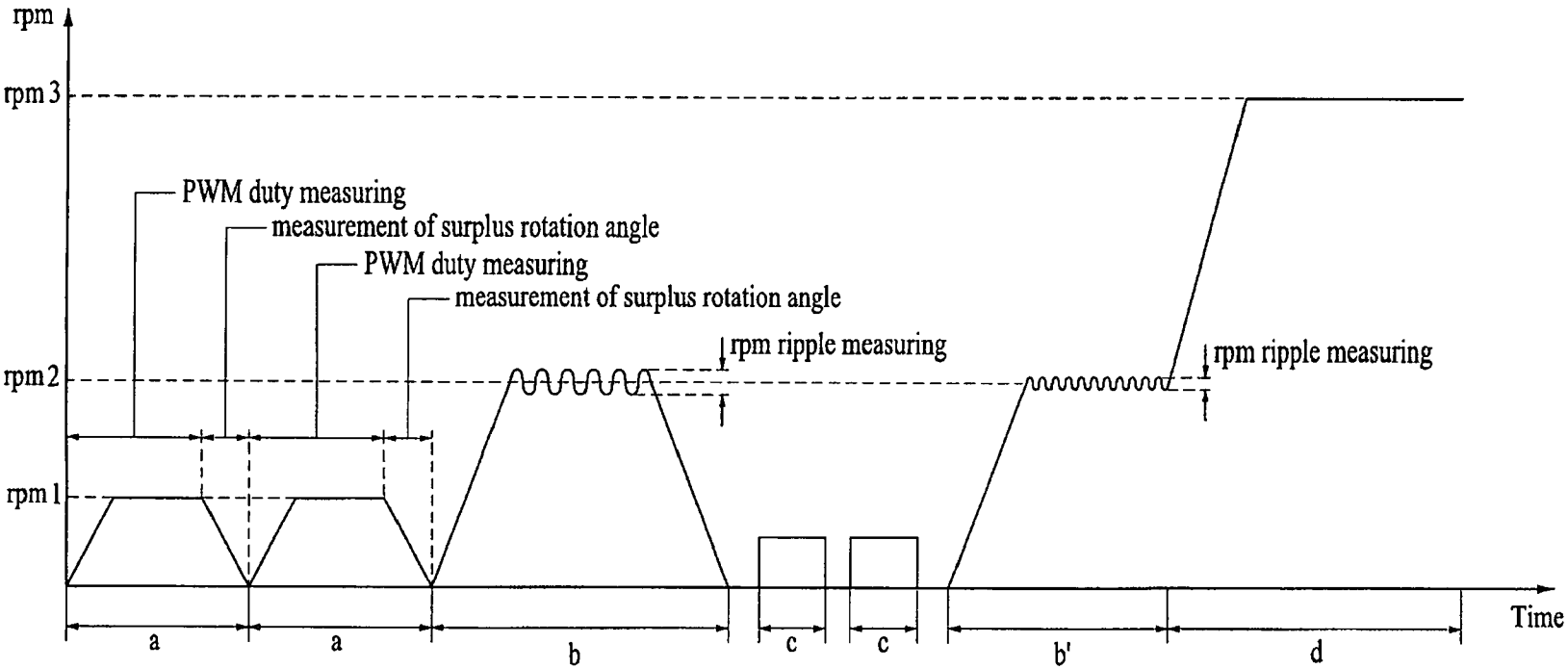
FIG. 2 Related Art
FIG. 2 is a graph illustrating RPM of a motor with respect to time during a dehydrating cycle of the conventional drum type washing machine
Figure 3:
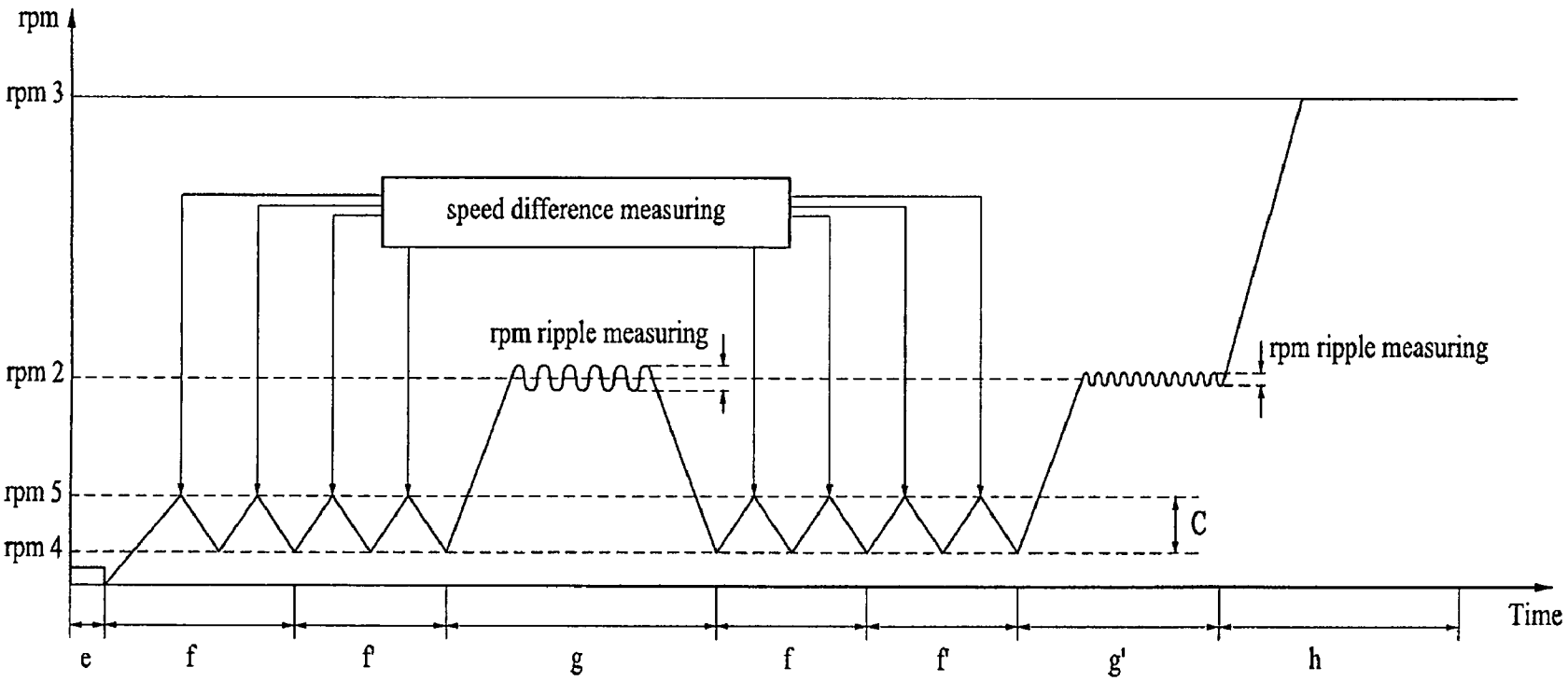
FIG. 3 is a graph illustrating an RPM of a motor during a dehydrating cycle in a dehydrating method of a drum type washing machine according to a preferred embodiment of the present invention.
Figure 4:
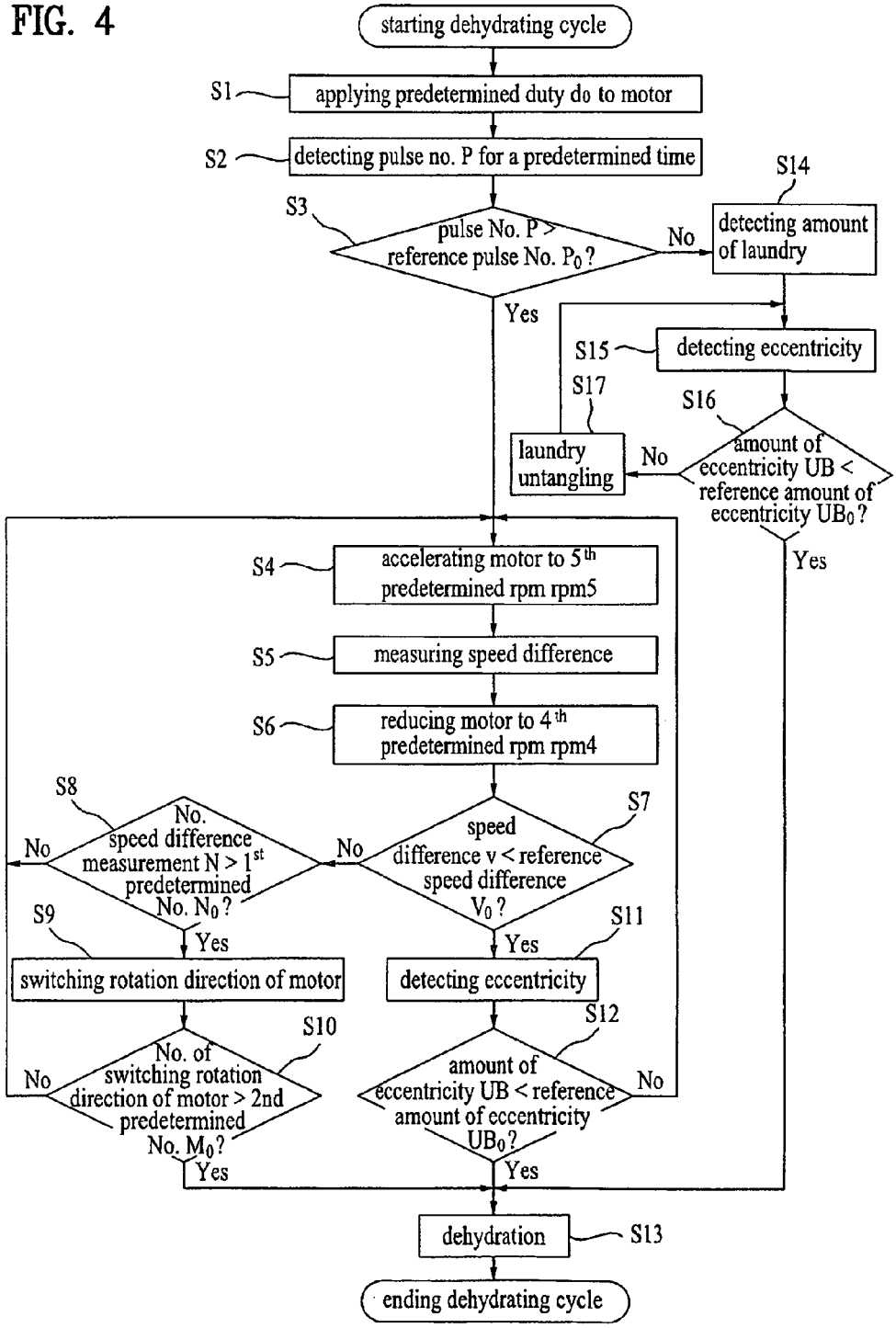
FIG. 4 is a flowchart illustrating the dehydrating method of a drum type washing machine according to the preferred embodiment of the present invention.
Figure 5:
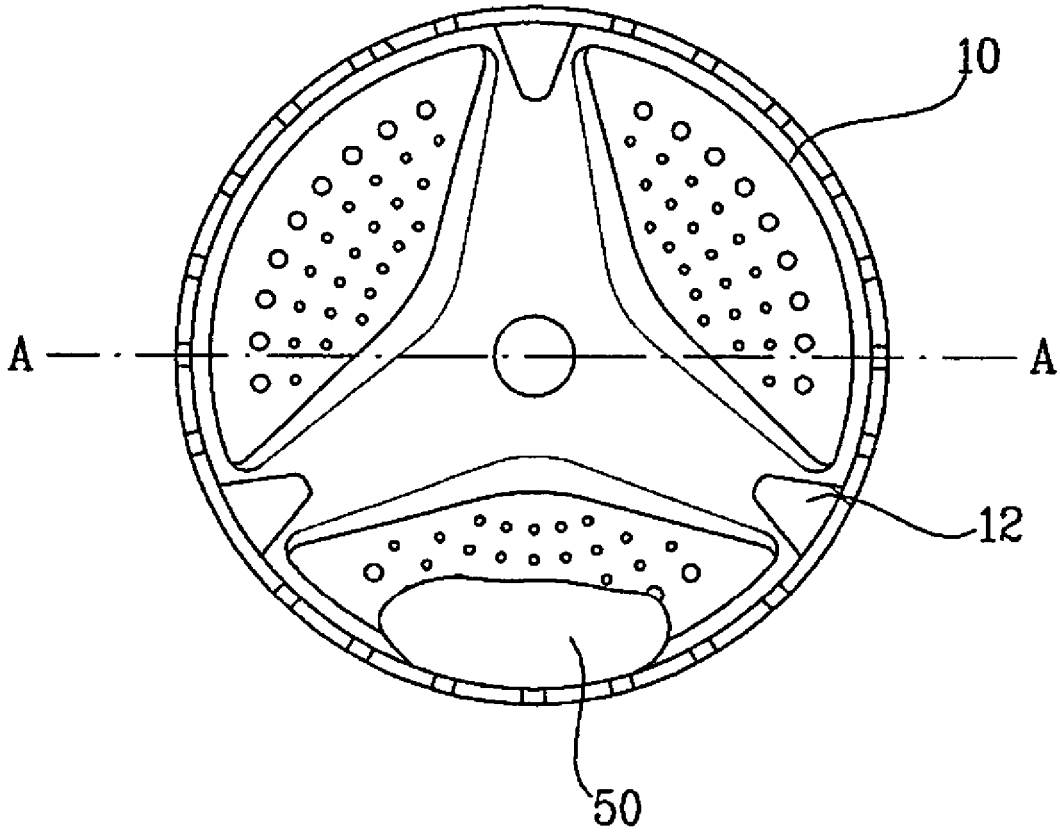
FIG. 5 is a reference view illustrating a single load detection method of the dehydrating method of a drum type washing machine according to the preferred embodiment of the present invention.
Figure 6:
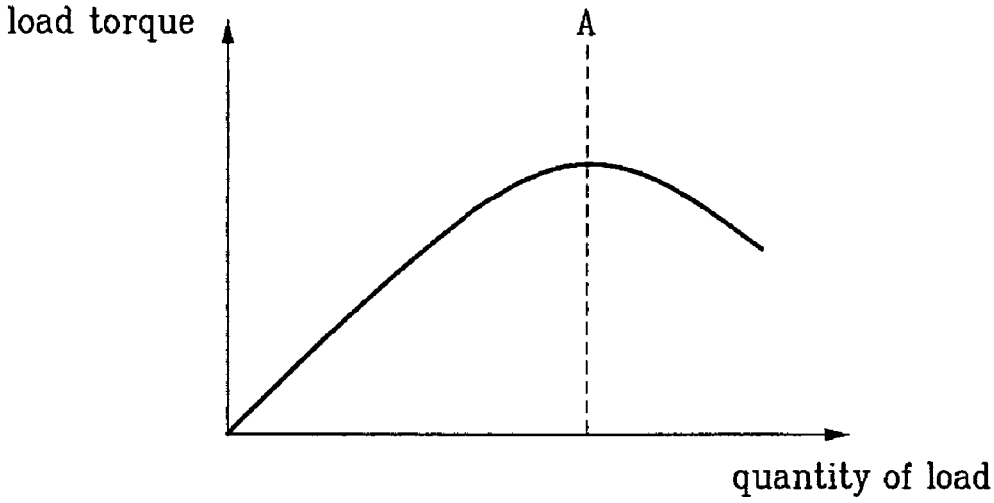
FIG. 6 is a graph illustrating the single load detection method of the dehydrating method of a drum type washing machine according to the preferred embodiment of the present invention.
Figure 7:
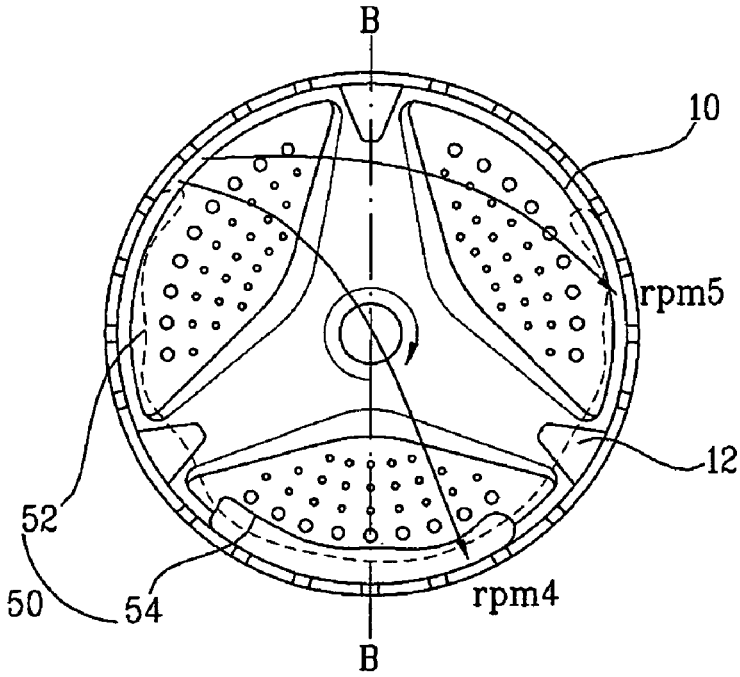
FIG. 7 is a reference view illustrating a single load untangling method of the dehydrating method of a drum type washing machine according to the preferred embodiment of the present invention.
Figure 8:
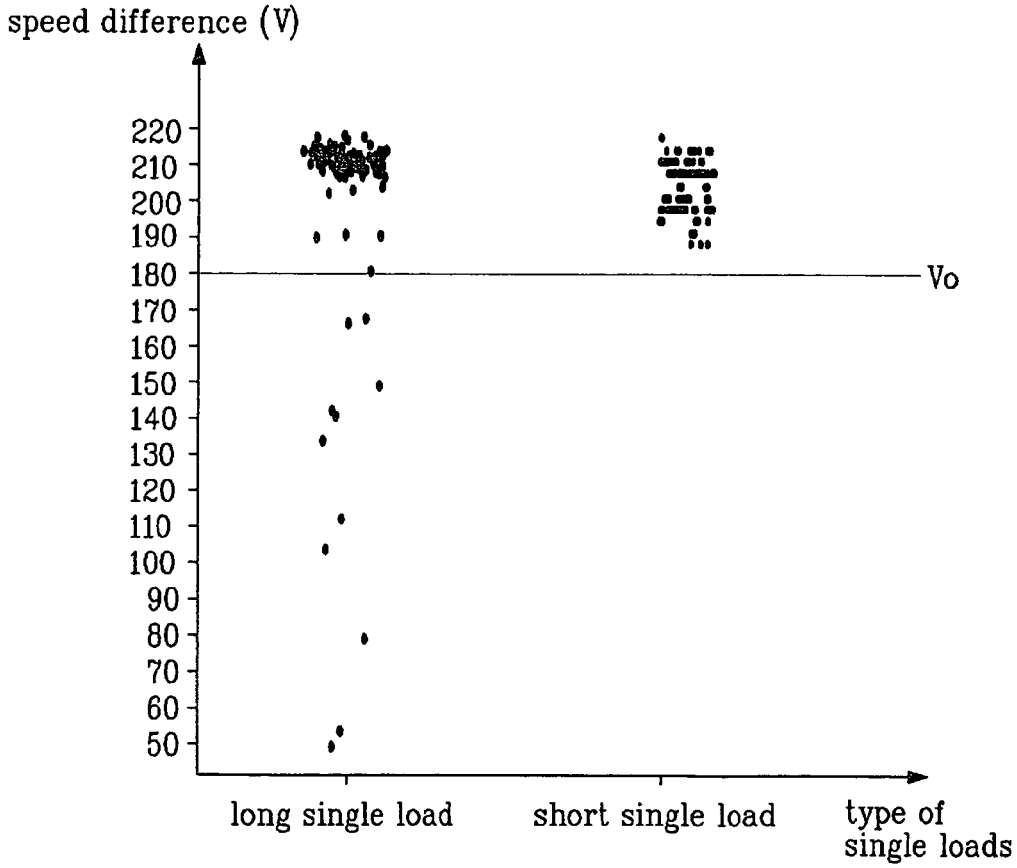
FIG. 8 is a graph illustrating a single load distinguishing method of the dehydrating method of a drum type washing machine according to the preferred embodiment of the present invention.

FIG. 3 is a graph illustrating an RPM of a motor during a dehydrating cycle in a dehydrating method of a drum type washing machine according to a preferred embodiment of the present invention, FIG. 4 is a flowchart illustrating the dehydrating method of a drum type washing machine according to the preferred embodiment of the present invention, FIGS. 5 and 6 are a reference view and a graph illustrating a single load detection method of the dehydrating method of a drum type washing machine according to the preferred embodiment of the present invention, FIG. 7 is a reference view illustrating a single load untangling method of the dehydrating method of a drum type washing machine according to the preferred embodiment of the present invention, and FIG. 8 is a graph illustrating a single load distinguishing method of the dehydrating method of a drum type washing machine according to the preferred embodiment of the present invention.

Wherever possible, the same reference numbers will be used throughout the drawings to refer to the same or like parts, and additional description for the same will be omitted.

A dehydrating method of a drum type washing machine according to the preferred embodiment of the present invention, as shown in FIGS. 3 to 8, includes the single load detecting step (time period e) of detecting whether or not laundry 50 inserted into a drum 10 is a single load, a single load untangling step (time periods f and f') of untangling the laundry 50 and determining whether or not to perform a detection of eccentricity when the laundry 50 is determined to be a single load, an eccentricity detecting step (time period g and g') of detecting eccentricity of the laundry 50 and determining whether to perform a main dehydration or a untangling of laundry, and a main dehydrating step (time period h) of controlling a motor 14 at a high speed when the eccentricity of the laundry 50 is removed or the laundry 50 is determined to be the single load.

When the laundry 50 is not determined to be the single load, following steps may be identical to those of the conventional dehydrating method.

In the single load detecting step (time period e), after a voltage corresponding to a voltage ratio of a predetermined duty $D_0$ is applied to the motor 14, RPM of the drum 10 is detected for a predetermined time period to determine whether or not the laundry 50 inserted into the drum 10 is a single load (See S1, S2, and S3). Naturally, this single load detecting step is preferably carried out at early stage of a dehydrating cycle.

When the voltage is applied to the motor at the predetermined duty D0, the motor 14 generates running torque in proportion to the applied voltage, the running torque is transmitted to the drum 10, the drum 10 is rotated according to a load torque caused by the laundry 50 or the rotation of the drum 10 is restricted by the load torque.

Meanwhile, in the drum 10, as shown in FIGS. 5 and 6, as the laundry 50 is inserted into the drum 10 and the quantity of the load is increased, the load torque of the motor 14 is increased. When the laundry 50 is inserted into the drum 10 greater than a maximum load point A of the drum 10, the load torque is decreased even when the quantity of the load is increased.

Thus, since the load torque and the quantity of the load caused by the laundry 50 linearly vary up to the maximum load point A, at a point below the maximum load point A, the quantity of the laundry 50 inserted into the drum 10 can be indirectly measured by the load torque caused by the laundry 50.

$$\text{load torque} \quad \text{Formula 1}$$

$$\left\{\begin{array}{l}\text{running torque of motor} \propto \text{current applied to motor} \propto \\ \qquad \text{voltage applied to motor} \propto \text{duty } D\end{array}\right.$$

$$\text{voltage applied to motor} = \text{supplied voltage} \times \frac{D}{255}$$

As illustrated in formula 1, the running torque of the motor 14 is proportional to electric current applied to the motor 14, the applied electric current of the motor 14 is proportional to voltage applied to the motor 14, and the applied voltage of the motor 14 is proportional to the magnitude of the duty D.

The supplied voltage is a voltage supplied to the drum type washing machine 1 from an external power supply, the duty D is changed by an inverter installed in the drum type washing machine 1 so that the magnitude of the voltage is changed.

The duty D is a voltage ratio applied to the motor 14, and particularly, is a predetermined value used in determining whether or not the laundry 50 inserted into the drum 10 is a single load.

In other words, in the single load detecting step (time period e), the applied voltage of the motor 14 corresponding to the predetermined duty $D_0$ is applied to the motor 14, and a predetermined magnitude running torque generated by the motor 14 is transmitted to the drum 10.

At this time, a hall sensor 22 of the motor 14 generates a pulse signal based on positional change of the motor 14, and due to the pulse number P of the pulse signal, RPM of the motor 14, a rotation angle of the motor, and a revolution of the drum 10 can be measured.

Thus, when the pulse number P of the hall sensor 22 for a predetermined time after a predetermined voltage is applied to the motor 14, the pulse number P is compared with a reference pulse number $P_0$ so that it can be determined whether or not the laundry 50 inserted into the drum 50 is a single load.

The reference pulse number $P_0$ is a pulse number P of the hall sensor 22 detected for the predetermined time after a voltage caused by the predetermined duty $D_0$ is applied to the motor 14 when the laundry 50 inserted into the drum 50 is a single load having a maximum load. In other words, the pulse number P of the hall sensor 22 means the revolution of the drum 10 rotating for the predetermined time, and the reference pulse number $P_0$ means a reference revolution of the drum 10 when the laundry 50 is the single load having the maximum load.

Thus, when the pulse number P is greater than the reference pulse number $P_0$, the laundry 50 is determined to be the single load, and when the pulse number P is smaller than the reference pulse number $P_0$, the laundry 50 is not determined to be the single load.

In other words, assuming that the non-single load is greater than the single load in view of the quantity of load, then the greater the quantity of load, the smaller the revolution of the drum 10 at a predetermined running torque. Thus, the non-single load is determined when the revolution of the drum 10 is smaller than the revolution of the drum 10 at a predetermined maximum single load, that is, the reference revolution.

In more detail, in a drum type washing machine 1 having the pulse number P of '40' detected by the hall sensor 22 when the drum 10 rotates once, when the reference pulse number P0 is determined to be '40' and the pulse number P is detected as '30', since the quantity of load of the laundry 50 is greater than the maximum quantity of load of the single load, the laundry 5 is determined to be the non-single load.

On the contrary, when the reference pulse number $P_0$ is determined to be '40' and the pulse number P is detected as '50', since the quantity of load of the laundry is smaller than the maximum quantity of load, the laundry 50 is determined to be the single load.

In other words, when the drum 10 rotates less than one turn for a predetermined time, the non-single load is determined, and when the drum 10 rotates over one turn for the predetermined time, the single load is determined.

The predetermined time and the reference pulse number $P_0$ may be changed in various manners according to the dehydrating conditions of the drum type washing machine 1.

Thus, it can be precisely determined whether or not the laundry 50 inserted into the drum 10 is a single load within a short time. Moreover, the determination of the single load is carried out in the early stage of the dehydrating cycle to perform the dehydrating cycle correctly for the single load. Thus, the laundry is effectively dehydrated.

In the single load untangling step (time period f and f'), the untangling and a measurement of speed difference can be carried out at the same time.

In the untangling, the motor 14 is repeatedly accelerated and reduced in the time periods of the laundry flowing RPM C where the laundry 50 flows, so as to untangle the laundry 50 for the removal of the eccentricity.

In the measurement of the speed difference, the speed difference V of the drum 10 due to the eccentricity of the laundry 50 is detected at the time point when the motor 14 is completely accelerated to determine whether or not the single load eccentricity detecting step (time periods g and g') is to be started (See S4, S5, S6, S7, S8, S9, and S10). Here, the reason measurement of the speed difference is carried out at the time point when the motor 14 is completely accelerated is to enable effective measurement of the speed difference because the speed difference is the greatest at this time point.

The laundry flowing RPM C is an RPM range when the laundry 50 flows and is untangled and by the rotation of the drum 10, and the motor 14 is accelerated to a fifth RPM RPM5 as a maximum RPM of the laundry flowing RPM C and is reduced down to a fourth RPM RPM4 as a minimum RPM of the laundry flowing RPM C to perform the untangling of the laundry 50.

As shown in FIG. 7, the fourth RPM RPM4 is a minimum RPM where the laundry 50 flows left to right about a central axis B during the rotation of the drum 10, and the fifth RPM RPM5 is a minimum RPM where the laundry 50 closely contacts the inner circumference of the drum 10 and is not separated therefrom during the rotation of the drum 10.

The speed difference V is a difference value between the speeds of the drum 10 when the laundry 50 is lifted up, above the fifth RPM RPM5, and the speed of the drum 10 when the laundry 50 drops.

In other words, when the laundry 50 is eccentrically disposed in the drum 10, the speed of the drum when the laundry 50 is lifted up becomes slow and the speed difference is measured as a large value because the speed of the drum 10 when the laundry 50 drops becomes fast. When the laundry 50 is disposed uniformly in the drum 10, since the speed of the drum 10 when the laundry 50 is lifted up is similar to the speed of the drum 10 when the laundry 50 drops, the speed difference V is measured as a small value.

The speed difference V is compared with a reference speed difference $V_0$ so that it is determined whether the single load eccentricity detecting step (time periods g and g') is to be started or the laundry untangling step is to be carried out again.

In other words, when the speed difference V is measured smaller than the reference speed difference $V_0$, it is determined that the laundry 50 is uniformly unfolded in the drum 10 so that the single load eccentricity detecting step (time periods g and g') is started. However, when the speed difference V is measured greater than the reference speed difference $V_0$, it is determined that the laundry 50 is eccentrically unfolded in the drum 10 so that the laundry untangling step is carried out again.

Thus, since the single load eccentricity detecting step (time periods g and g') is carried out only when the eccentricity of the laundry 50 is removed to a predetermined degree, the detection of the eccentricity in the single load eccentricity step (time periods g and g') is carried out at a proper time.

Here, since the laundry untangling step is repeated a predetermined number of times, the laundry untangling step is repeated until the number N of the speed difference measurement is the same as a first predetermined number $N_0$ only in the same direction. When the number N of the speed difference is the same as the first predetermined number $N_0$, the rotation direction is switched to repeat the laundry untangling until the number M of a rotation direction switching is the same as a second predetermined number M0 of rotation direction switching.

The laundry untangling step is repeated only in the same direction within the time period of the laundry flowing RPM C. Thus, since the rotation direction, unlike the conventional art, is not reversed whenever the laundry untangling is carried out and the motor 14 is not reduced lower than an RPM where the laundry untangling is not carried out, time for the laundry untangling is significantly reduced.

Since, the measurement of the speed difference is respectively measured at points when the motor 14 is accelerated up to the fifth predetermined RPM RPM5 whenever the laundry untangling step is repeated several times, it is determined whether or not the single load eccentricity detecting step (time period g and g') is started whenever the laundry untangling is carried out.

The measurement of the speed difference is very similar to the following eccentricity detecting and measuring methods of the single load eccentricity detecting step (time periods g and g').

In more detail, the eccentricity detection is carried out to measure variation of the RPM of the motor 14 during the operation of the motor at a uniform speed while the motor is accelerated up to the second predetermined RPM RPM2 and the laundry 50 closely contacts the inner circumference of the drum 10. However, in the measurement of the speed difference, the speed difference V of the drum 10 is measured only once for the fifth predetermined RPM RPM5 smaller than the second predetermined RPM RPM2.

In other words, the measurement of the speed difference and the eccentricity detection are variations of speed measured when the laundry 50 closely contacts the inner circumference of the drum 10. Through the measurement of the speed difference, the eccentricity of the laundry 50 can be approximately detected before the eccentricity detection. Thus, since time when the eccentricity detection is started is precisely determined by the measurement of the speed difference, time to start the eccentricity detection is reduced and the number of times of the eccentricity detection is performed, is decreased.

Meanwhile, in the single load laundry untangling step (time periods f and f'), the single load can be distinguished as a long single load 52 and a short single load 54 according to a length of the laundry when the laundry is unfolded by the measurement of the speed difference. In other words, it can be carried out to determine whether the single load is the long single load or the short single load.

Here, the long single load 52 is a single load such that the laundry is unfolded to be over a half of a length of the inner circumference of the drum 10, and the short single load 54 is a single load such that the laundry is unfolded to be under a half of a length of the inner circumference of the drum 10.

Detail examples of the short single load 54 and the long single load 52 are depicted in FIG. 7. Here, the solid line indicates the short single load and the dotted line indicates the long single load.

Thus, the long single load 52 and the short single load 54, as shown in FIG. 8, when the laundry untangling is repeated the predetermined number of times during the laundry untangling step, may be determined as the long single load 52 when the speed difference V has a value smaller than the reference speed difference $V_0$ even once, and may be determined as the short single load 54 when the speed difference V has a value greater than the reference speed difference $V_0$.

This is because the eccentricity of the long single load 52 is removed when the long single load 52 is unfolded to be long on the inner circumference of the drum in the circumferential direction during the laundry untangling so that the speed difference V may be smaller than the reference speed difference $V_0$. However, because the single load 54 is always eccentric even when the short single load 54 is completely unfolded, the speed difference V cannot be smaller than the reference speed difference $V_0$ even when the laundry untangling is carried out several times.

In the single load eccentricity detecting step (time periods g and g'), when the speed difference V is detected to be smaller than the reference speed difference V0 at the single load laundry untangling step (time periods f and f') such that the laundry 50 inserted into the drum 10 is determined to be the long single load 52, whether or not the main dehydrating step (time period h) is started is determined according to the eccentricity amount UB obtained by the eccentricity detection after the eccentricity of the laundry 50 is carried out.

In other words, in the single load eccentricity detecting step (time periods g and g'), when the speed difference V is detected to be smaller than the reference speed difference $V_0$ at the laundry untangling, the motor 14 is accelerated up to the second predetermined RPM RPM2, greater than the fourth and fifth predetermined RPMs RPM4 and RPM5, during the laundry untangling, and the motor 14 is turned off after the second predetermined RPM RPM2 is maintained, as a uniform speed when the RPM of the motor 14 reaches the second predetermined RPM RPM2. At this time, the eccentricity is detected by RPM ripple at the time period where the motor 14 uniformly rotates at the second predetermined RPM RPM2.

When the eccentricity amount UB detected by the eccentricity detection is greater than a reference eccentricity amount $UB_0$, in order to remove the eccentricity amount UB, the single load laundry untangling step (time periods f and f') is carried out again and the eccentricity detection is carried out.

In other words, when it is determined that it is not proper time to start the main dehydrating step (time period h) because the long single load 52, that is, the laundry 50 is not unfolded or the laundry 50 is not completely unfolded, the laundry 50 is further untangled to remove the eccentricity during the laundry untangling.

On the contrary, in the drum type washing machine 1, when the eccentricity amount UB detected by the eccentricity detection at the first time or the eccentricity amount UB detected after the laundry untangling is repeated is smaller than the reference eccentricity amount $UB_0$, the main dehydrating step (time period h) is started.

In the main dehydrating step (time period h), the motor 14 is activated at the third predetermined RPM RPM3 higher than the second predetermined RPM RPM2 so that the laundry 50 inserted into the drum 10 is dehydrated by the centrifugal force at a high speed.

Particularly, when during the single load laundry untangling step (time periods f and f'), the speed difference V is detected to be significantly greater than the reference speed difference $V_0$ so that the laundry 50 inserted into the drum 50 is determined to be the short single load 54, the single load eccentricity detecting step (time periods g and g') is not carried out but the main dehydrating step (time period h) is directly carried out.

This is because in this case, that the laundry untangling step is further carried out or the eccentricity detecting step is carried out is meaningless.

Thus, since unnecessary operation such as the laundry untangling for removing the eccentricity of the short single load 54 or the eccentricity detection for detecting the eccentricity is omitted, like the conventional dehydrating method, in the main dehydrating step (time period h), time and number of operations for dehydration are significantly reduced when the laundry 50 is determined to be the short single load.

Since the laundry quantity of the short single load 54 is not great, the spring 4 and the damper 6 provide sufficient buffering even when the dehydration is carried out for the eccentric state.

Particularly, in the single load laundry untangling step (time periods f and f'), since the laundry 50 is determined as the long single load 52 or the short single load 54, the dehydrating cycle is carried out in an optimum method according to the type of the single load so that the vibration properties at the main dehydrating step (time period h) with respect to the single load is improved.

Meanwhile, in the single load detecting step (time period e), since, when the pulse number P is smaller than the reference pulse number $P_0$ so that the laundry 50 is determined to be the non-single load, the dehydrating cycle may be carried out by the same method as the conventional dehydrating method, its detail description will be omitted.

The following effects can be obtained by a method of dehydrating a drum type washing machine according to the present invention.

First, since it is determined whether the laundry inserted into the drum is a single load and a following dehydrating method varies with the determination result, it is possible to improve dehydrating effect and to reduce dehydrating time and energy.

Second, since the RPM of the drum is detected for a set time after a set voltage is applied to a motor and it is determined that the laundry is the single load when the RPM of the drum is larger than a reference RPM, it is possible to correctly determine whether the laundry inserted into the drum is the single load and to reduce the time for determining whether the laundry inserted into the drum is the single load.

Third, since it is possible to correctly detect whether the laundry inserted into the drum is the single load at an initial time so that the dehydration can be performed by an optimal dehydrating method suitable for the characteristics of the laundry, it is possible to improve the vibration properties of the drum type washing machine and to minimize the vibration of the drum type washing machine.

Fourth, since the following dehydrating method varies with the length of the single load, it is possible to improve the dehydrating effect.

Also, according to the present invention, since it is possible to improve the dehydrating effect and to reduce the dehydrating time and energy, it is possible to improve the reliability of a product.

It will be apparent to those skilled in the art that various modifications and variations of the dehydrating method of a drum type washing machine can be made in the present invention without departing from the spirit or scope of the inventions. Thus, it is intended that the present invention covers the modifications and variations of this invention provided they come within the scope of the appended claims and their equivalents.

What is claimed is:

1. A dehydrating method of a drum type washing machine dehydrating water included in laundry by a motor rotating a drum, the dehydrating method comprising:

a step of determining whether the laundry is a single item based on an RPM of the drum;

when it is determined that the laundry is the single item, untangling the laundry by increasing and reducing speed of the motor in a laundry flowing RPM period; and during the laundry untangling step, measuring a speed deviation of the drum caused by an eccentricity of the laundry to determine whether to start detecting the eccentricity, wherein the step of measuring the speed deviation of the drum is performed at the point of time when the speed is increased to a minimum RPM in which the laundry is not detached in the laundry untangling step.

2. The dehydrating method of as set forth in claim 1, wherein the step of determining whether the laundry is the single item is performed in an initial state of dehydration.

3. The dehydrating method of as set forth in claim 1, wherein, in the step of determining whether the laundry is the single item, the RPM of the drum is sensed for a predetermined time after a set voltage is applied to the motor so that it is determined that the laundry is the single item when the RPM of the drum is larger than a reference RPM.

4. The dehydrating method of as set forth in claim 3, wherein the set voltage is obtained by setting a voltage input from an external power source as a voltage ratio of a set duty.

5. The dehydrating method of as set forth in claim 3, wherein the reference RPM is the RPM of the drum when the set voltage is applied to the motor and the laundry is the single item having the maximum amount of load.

6. The dehydrating method of as set forth in claim 1, wherein, when it is determined in the step of determining whether the laundry is the single item that the laundry is non-single item, further comprising the steps of: detecting the quantity of the laundry; detecting the eccentricity of the laundry; and rotating the drum at high speed to perform dehydration.

7. The dehydrating method of as set forth in claim 6, further comprising a laundry untangling step when the detected eccentricity has no less than a predetermined value in the step of detecting the eccentricity.

8. The dehydrating method of as set forth in claim 7, wherein the dehydration time or dehydration RPM in the step of rotating the drum at high speed to perform dehydration is determined by the quantity of the laundry detected in the step of detecting the quantity of the laundry.

9. The dehydrating method of as set forth in claim 1, wherein, when it is determined in the step of determining whether the laundry is the single item that the laundry is the single item, further comprising the steps of:

detecting the eccentricity of the laundry; and rotating the drum at high speed to perform dehydration.

10. The dehydrating method as set forth in claim 1, wherein the laundry flowing RPM period is a period between the minimum RPM in which the laundry flows in the drum and the minimum RPM in which the laundry closely contacts the inner circumference of the drum so that the laundry is not detached.

11. The dehydrating method as set forth in claim 10, wherein, the laundry untangling step further comprising a sub-step of untangling the laundry by increasing the drum speed to the minimum RPM in which the laundry is not detached and reducing the drum speed to the minimum RPM in which the laundry flows.

12. The dehydrating method as set forth in claim 1, wherein the speed difference is a difference between the speed of the drum when the laundry is lifted and the speed of the drum when the laundry falls, and the eccentricity detecting step starts when the measured speed difference is less than the reference speed difference.

13. The dehydrating method as set forth in claim 12, wherein the sub-step of untangling the laundry is repeated performed by a first predetermined number of times in the same rotation direction, and the sub-step of measuring the speed deviation of the drum is performed whenever the laundry untangling step is repeatedly performed.

14. The dehydrating method as set forth in claim 13, wherein, when the eccentricity detection step does not start until the speed deviation measuring number of times reach the first set number of times, the sub-step of untangling the laundry is repeatedly performed until the speed deviation measuring number of times reach a second set number of times after the rotation direction of the drum is reversed.

15. The dehydrating method as set forth in claim 1, wherein the laundry untangling step comprises a sub-step of determining the length of the single item based on the measured speed deviation.

16. The dehydrating method as set forth in claim 15, wherein, when the step does not proceed from the laundry untangling step to the eccentricity detecting step, it is determined that the single item is short single item to start the main dehydration step.

17. The dehydrating method as set forth in claim 15, wherein, when the plurality of speed difference measured in the sub-step of measuring the speed deviation of the drum are no less than the reference speed difference, it is determined that the single item is short single item to start the main dehydration step.

18. The dehydrating method as set forth in claim 15, wherein, when at least one of the plurality of speed differences measured in the sub-step of measuring the speed deviation of the drum is less than the reference speed deviation, it is determined that the single item is long single item to start the eccentricity detecting step.

19. The dehydrating method as set forth in claim 18, wherein, when it is determined that the eccentricity of the laundry is smaller than the reference eccentricity in the eccentricity detecting step, the main dehydration step start, and when the eccentricity of the laundry is larger than the reference eccentricity, the laundry untangling step is performed again.

* * * * *